US007147054B2

(12) United States Patent
Wang et al.

(10) Patent No.: US 7,147,054 B2
(45) Date of Patent: Dec. 12, 2006

(54) GRAVEL PACKING A WELL

(75) Inventors: David Wei Wang, Manvel, TX (US); Bruno Khan, Houston, TX (US); Michael D. Langlais, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 209 days.

(21) Appl. No.: 10/654,101

(22) Filed: Sep. 3, 2003

(65) Prior Publication Data

US 2005/0045327 A1 Mar. 3, 2005

(51) Int. Cl.
*E21B 43/04* (2006.01)
*E21B 43/08* (2006.01)

(52) U.S. Cl. ..... 166/278; 166/51; 166/227

(58) Field of Classification Search ..... 166/51, 166/278, 227
See application file for complete search history.

(56) References Cited

U.S. PATENT DOCUMENTS

| | | | |
|---|---|---|---|
| 4,407,183 | A | 10/1983 | Milberger |
| 4,945,991 | A | 8/1990 | Jones |
| 5,082,052 | A | 1/1992 | Jones et al. |
| 5,113,935 | A | 5/1992 | Jones et al. |
| 5,161,613 | A | 11/1992 | Jones |
| 5,161,618 | A | 11/1992 | Jones et al. |
| 5,251,699 | A | 10/1993 | Lau et al. |
| 5,333,688 | A | 8/1994 | Jones et al. |
| 5,390,966 | A | 2/1995 | Cox et al. |
| 5,419,394 | A | 5/1995 | Jones |
| 5,435,391 | A | 7/1995 | Jones |
| 5,515,915 | A | 5/1996 | Jones et al. |
| 5,560,427 | A | 10/1996 | Jones |
| 5,588,487 | A | 12/1996 | Bryant |
| 5,690,175 | A | 11/1997 | Jones |
| 5,842,516 | A | 12/1998 | Jones |
| 5,848,645 | A | 12/1998 | Jones |
| 5,868,200 | A | 2/1999 | Bryant et al. |
| 5,890,533 | A | 4/1999 | Jones |
| 6,059,032 | A | 5/2000 | Jones |
| 6,179,052 | B1 | 1/2001 | Purkis |
| 6,220,345 | B1 | 4/2001 | Jones et al. |
| 6,227,303 | B1 | 5/2001 | Jones |
| 6,247,536 | B1 | 6/2001 | Leismer |
| 6,298,916 | B1 | 10/2001 | Tibbles et al. |
| 6,409,219 | B1 | 6/2002 | Broome et al. |
| 6,464,007 | B1 | 10/2002 | Jones |
| 6,481,494 | B1 * | 11/2002 | Dusterhoft et al. ..... 166/51 |

(Continued)

FOREIGN PATENT DOCUMENTS

| | | | |
|---|---|---|---|
| GB | 2335216 | A | 9/1999 |

(Continued)

*Primary Examiner*—Hoang Dang
(74) *Attorney, Agent, or Firm*—Trop, Pruner & Hu, P.C.; Kevin P. McEnaney; Jaime A. Castano

(57) ABSTRACT

A technique that is usable with a subterranean well includes communicating a slurry through a shunt flow path and operating a control device to isolate slurry from being communicated to an ancillary flow path. The system may include a shunt tube and a diverter. The shunt tube is adapted to communicate a slurry flow within the well to form a gravel pack. The diverter is located in a passageway of the shunt tube to divert at least part of the flow. A slurry may be communicated through the shunt flow path, and a control device may be operated to isolate the slurry from being communicated to the ancillary flow path.

40 Claims, 6 Drawing Sheets

U.S. PATENT DOCUMENTS

| | | | | |
|---|---|---|---|---|
| 6,520,254 | B1 | 2/2003 | Hurst et al. | |
| 6,588,506 | B1 | 7/2003 | Jones | |
| 6,588,507 | B1 * | 7/2003 | Dusterhoft et al. | 166/278 |
| 6,702,019 | B1 * | 3/2004 | Dusterhoft et al. | 166/278 |
| 2002/0053439 | A1 | 5/2002 | Danos | |
| 2002/0079099 | A1 | 6/2002 | Hurst et al. | |
| 2002/0104650 | A1 * | 8/2002 | Dusterhoft et al. | 166/227 |
| 2002/0174984 | A1 | 11/2002 | Jones | |
| 2002/0189808 | A1 | 12/2002 | Nguyen et al. | |
| 2002/0189809 | A1 | 12/2002 | Nguyen et al. | |
| 2003/0000700 | A1 | 1/2003 | Hailey, Jr. | |
| 2003/0010496 | A1 | 1/2003 | McGregor et al. | |
| 2003/0029613 | A1 | 2/2003 | Danos et al. | |
| 2003/0034160 | A1 | 2/2003 | Nguyen et al. | |

FOREIGN PATENT DOCUMENTS

| | | | |
|---|---|---|---|
| GB | 2385616 | A | 8/2003 |
| WO | 99/47788 | A1 | 9/1999 |
| WO | 00/04273 | A1 | 1/2000 |
| WO | 01/63089 | A1 | 8/2001 |

* cited by examiner

GRAVEL PACKING A WELL

BACKGROUND

The invention generally relates to gravel packing a well.

When well fluid is produced from a subterranean formation, the fluid typically contains particulates, or "sand." The production of sand from the well must be controlled in order to extend the life of the well. One technique to accomplish this involves routing the well fluid through a downhole filter formed from gravel that surrounds a sandscreen. More specifically, the sandscreen typically is a cylindrical mesh that is inserted into and is generally concentric with the borehole of the well where well fluid is produced. Gravel is packed between the annular area between the formation and the sandscreen, called the "annulus." The well fluid being produced passes through the gravel, enters the sandscreen and is communicated uphole via tubing that is connected to the sandscreen.

The gravel that surrounds the sandscreen typically is introduced into the well via a gravel packing operation. In a conventional gravel packing operation, the gravel is communicated downhole via a slurry, which is a mixture of fluid and gravel. A gravel packing system in the well directs the slurry around the sandscreen so that when the fluid in the slurry disperses, gravel remains around the sandscreen.

A potential challenge with a conventional gravel packing operation deals with the possibly that fluid may prematurely leave the slurry. When this occurs, a bridge forms in the slurry flow path, and this bridge forms a barrier that prevents slurry that is upstream of the bridge from being communicated downhole. Thus, the bridge disrupts and possibly prevents the application of gravel around some parts of the sandscreen.

One type of gravel packing operation involves the use of a slurry that contains a high viscosity fluid. Due to the high viscosity of this fluid, the slurry may be communicated downhole at a relatively low velocity without significant fluid loss. However, the high viscosity fluid typically is expensive and may present environmental challenges relating to its use. Another type of gravel packing operation involves the use of a low viscosity fluid, such as a fluid primarily formed from water, in the slurry. The low viscosity fluid typically is less expensive than the high viscosity fluid. This results in a better quality gravel pack (leaves less voids in the gravel pack than high viscosity fluid) and may be less harmful to the environment. However, a potential challenge in using the low viscosity fluid is that the velocity of the slurry must be higher than the velocity of the high viscosity fluid-based slurry in order to prevent fluid from prematurely leaving the slurry.

Thus, there exists a continuing need for an arrangement and/or technique that addresses one or more of the problems that are set forth above as well as possibly addresses one or more problems that are not set forth above.

SUMMARY

In an embodiment of the invention, a technique that is usable with a subterranean well includes communicating a slurry through a shunt flow path and operating a control device to isolate slurry from being communicated to an ancillary flow path.

In another embodiment of the invention, a system that is usable with a subterranean well includes a shunt tube and a diverter. The shunt tube is adapted to communicate a slurry flow within the well to form a gravel pack. The diverter is located in a passageway of the shunt tube to divert at least part of the flow.

In yet another embodiment of the invention, a technique that is usable with a subterranean well includes communicating a slurry through a shunt flow path and operating a control device to isolate the slurry from being communicated to an ancillary flow path.

Advantages and other features of the invention will become apparent from the following description, drawing and claims.

DETAILED DESCRIPTION

Figure 1:
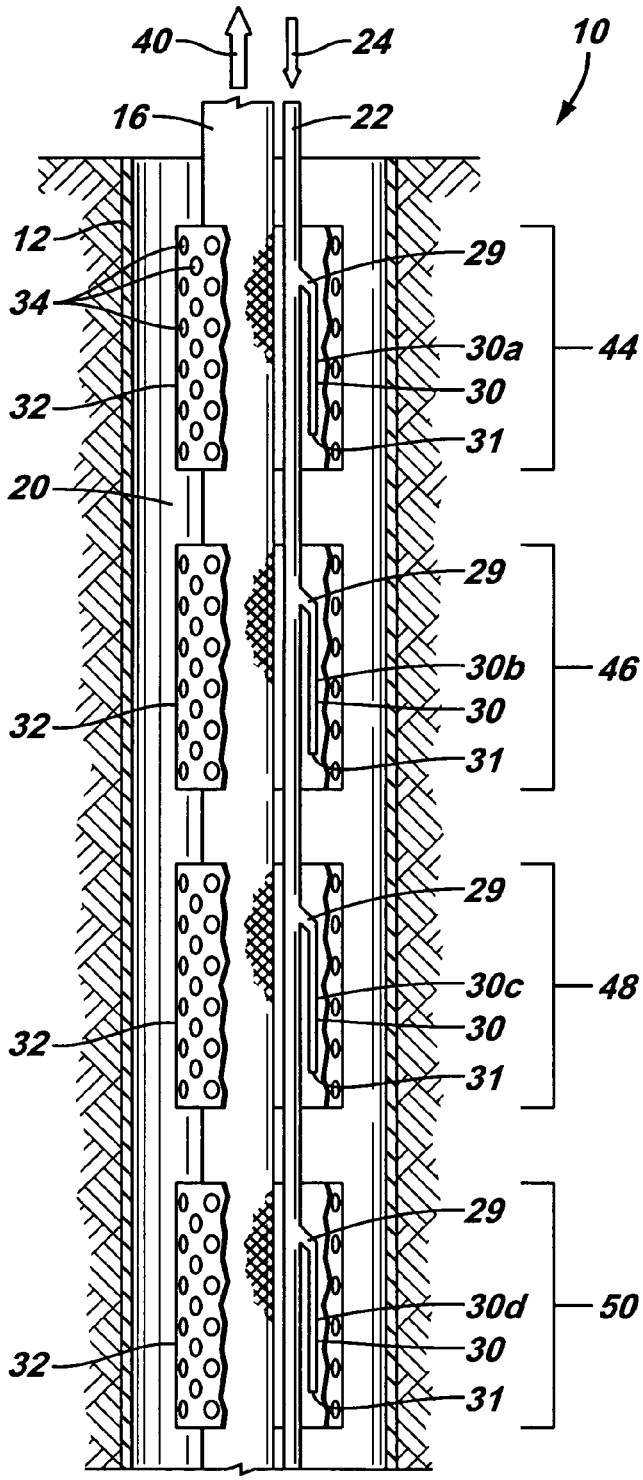
FIG. 1 is a schematic diagram of a gravel packing system according to an embodiment of the invention.

Referring to FIG. 1, an embodiment 10 of a gravel packing system in accordance with the invention includes a generally cylindrical sandscreen 16 that is inserted into a wellbore of a subterranean well. The sandscreen 16 is constructed to receive well fluid through its sidewall from one or more subterranean formations of the well. As shown in FIG. 1, the sandscreen 16 may be located inside a well casing 12 of the well. An annulus 20 is formed between the interior surface of the well casing 12 and the components of the system 10. It is noted that in some embodiments of the invention, the well may be uncased well, and thus, in these embodiments of the invention, the annulus 20 may be located between the components of the system 10 and the uncased wall of the wellbore.

In accordance with some embodiments of the invention, a two-phase gravel packing operation is used to distribute gravel around the sandscreen 16. The first phase involves gravel packing the well from the bottom up by introducing a gravel slurry flow into the annulus 20. As the slurry flow travels through the well, the slurry flow loses its fluid through the sandscreen 20 and into the formation. That which enters the sandscreen returns to the surface of the well. During the first phase of the gravel packing operation, one or more bridges may eventually form in the annulus 20 due to the loss of fluid to the formation, thereby precluding further gravel packing via the straight introduction of the slurry flow into the annulus 20. To circumvent these bridges, the gravel packing enters a second phase in which the slurry flow is routed through alternative slurry flow paths.

More particularly, in some embodiments of the invention, the alternative flow paths are formed at least in part by shunt flow paths that are established by one or more shunt tubes 22 (one shunt tube depicted in FIG. 1) that extend along the sandscreen 16. Therefore, as depicted in FIG. 1, in some embodiments of the invention, a particular shunt tube 22 may receive a gravel slurry flow 24 for purposes of bypassing one or more bridges that may be formed in the annulus 20.

More specifically, as depicted in FIG. 1, each shunt tube 22 may be connected to ancillary flow paths that are established by various packing tubes 30 (packing tubes 30*a*, 30*b*, 30*c* and 30*d*, depicted as examples) for purposes of distributing slurry through these tubes into the annulus 20. As shown, in some embodiments of the invention, each packing tube 30 has an upper end that is connected to a radial opening in the shunt tube 22; and the packing tube 30 extends along the shunt tube 22 to a lower outlet end at which the packing tube 30 delivers a slurry flow downstream of the radial opening. In some embodiments of the invention, each packing tube 30 may have several outlets that extend along the length of the packing tube 30.

As discussed further below, each of the depicted packing tubes 30*a*–*d* may be associated with a particular section of the well to be packed. For example, as depicted in FIG. 1, the packing tubes 30*a*–*d* may be associated with well sections 44, 46, 48 and 50, respectively. Each section may contain more than one packing tube 30 that is connected to the shunt tube 22; and each section may contain more than one shunt tube 22, depending on the particular embodiment of the invention. Furthermore, as depicted in FIG. 1, in some embodiments of the invention, the packing tubes 30 of a particular section may be surrounded by an outer shroud 32 that surrounds both the shunt tube(s) 22, packing tube(s) 30 and sandscreen 16. Each shroud 32 may include perforations 34 for purposes of receiving the gravel and fluid from the slurry. In this regard, the slurry may flow from the outside of the shroud 32 into the interior of shroud 32. Ideally, the fluid from the slurry flow 24 enters the screen 16, returns to the surface, as depicted by the flow 40, thereby leaving the deposited gravel around the exterior of the sandscreen 16.

In some embodiments of the invention, the shunt tube(s) 22 may be located outside of the shrouds 32; and in some embodiments of the invention, the shunt tubes 22 may be located both inside and outside of the shrouds 32. Thus, many variations are possible and are within the scope of the claims.

Figure 2:
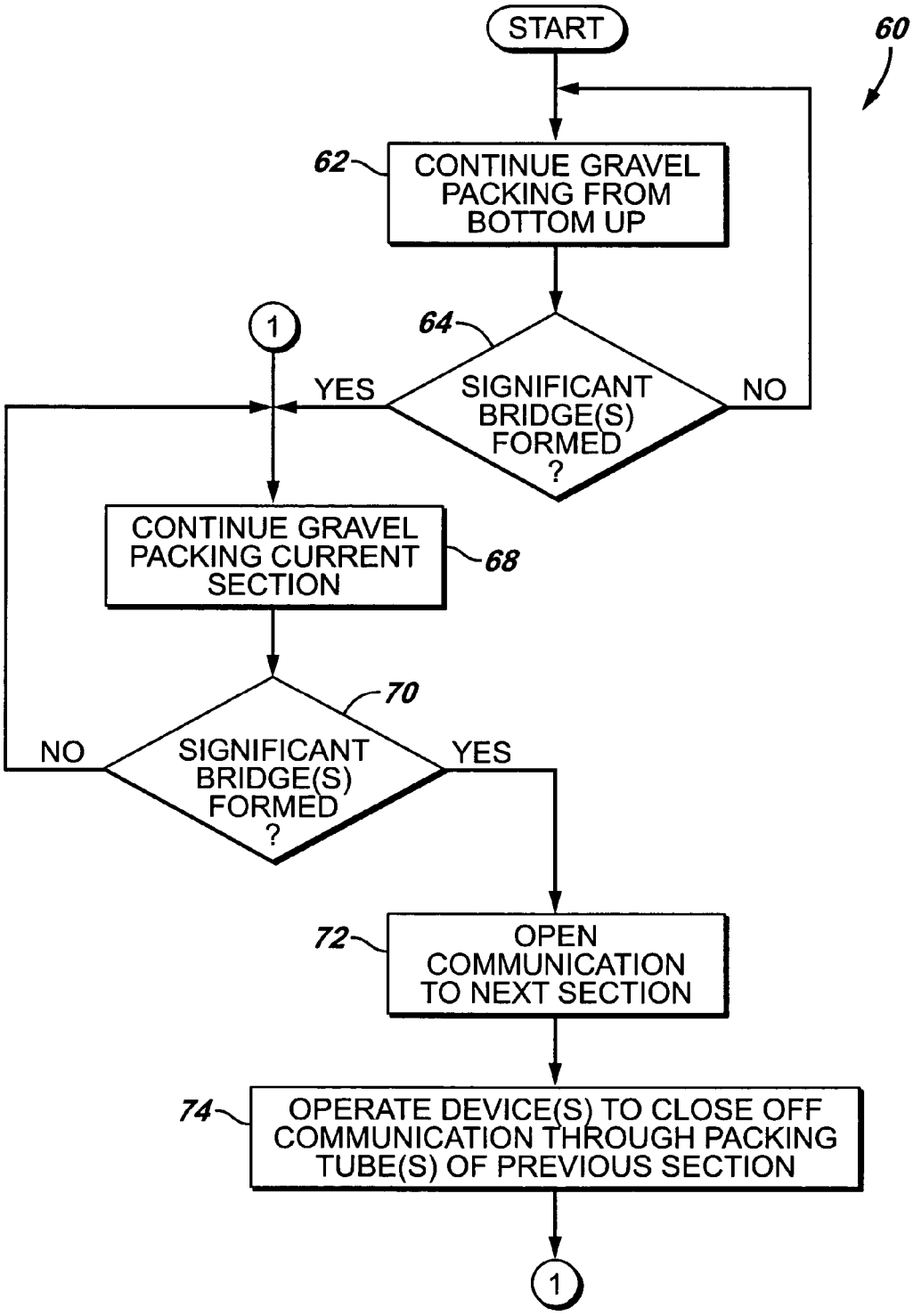
FIG. 2 is a flow diagram depicting a technique to gravel pack a well in accordance with an embodiment of the invention.

As a more specific example of the two phase gravel packing operation, FIG. 2 depicts a technique 60 that may be used to gravel pack the well using the system 10. In accordance with the technique 60, gravel packing initially proceeds from the bottom of the well to the top of the well. Thus, in this initial phase, the gravel slurry is introduced into the annulus 20 of the well. The gravel slurry enters the annulus 20 and proceeds with packing the annulus 20 with gravel from the bottom of the well up. This gravel packing from the bottom up (block 62) continues until one or more bridges are formed (diamond 64) that significantly impede the flow of slurry through the annulus 20. As described further below, this bridge increases a pressure in the slurry to activate the second phase of the gravel packing operation in which sections of the well are packed from top to bottom using alternative flow paths.

More specifically, using FIG. 1 as an example, at the onset of the second phase of the gravel packing operation, the upper section 44 is packed first, then the section 46, then the section 48, which is followed by the section 50, etc. The packing in a particular section continues until the bridge(s) that form in the annulus 20 and/or packing tubes 30 of that section significantly impede the flow of the slurry. Thus, in accordance with the technique 60, gravel packing for a particular section continues (block 68 of FIG. 2) until bridge(s) are formed (diamond 70) in the section that significantly impede the flow of slurry into that section. For example, for the section 44, a bridge may form in the packing tube 30*a* and/or other packing tubes 30 (not shown) to impede flow of the slurry enough to trigger a transition to the next section.

In some embodiments of the invention, the technique 60 includes preventing the communication through the shunt tube(s) between a particular section being packed and the adjacent section until the flow of slurry has been significantly impeded.

The significance of the blockage of the slurry flow affects the pressure of the slurry flow. Therefore, in some embodiments of the invention, the pressure increase initiates mechanisms (described below) that shut off packing in the current section and route the slurry flow to one or more alternate flow paths in the next section to be gravel packed. More particularly, when the bridge(s) cause the pressure of the slurry to reach a predetermined threshold (in accordance with some embodiments of the invention), communication to the next section to be packed is opened (block 72). Thus, slurry flows through the shunt tube(s) to the next section to be packed. Gravel packing thus proceeds to the next adjacent section, as depicted in block 68.

In some embodiments of the invention, one or more devices are operated to close off communication through the packing tube or tubes of the section at the conclusion of packing in that section, as described below. By isolating all packing tubes of previously packed sections, fluid loss is prevented from these sections, thereby ensuring that a higher velocity for the slurry may be maintained. This higher velocity, in turn, prevents the formation of bridges, ensures a better distribution of gravel around the sandscreen 16 and permits the use of a low viscosity fluid in the slurry (a fluid having a viscosity less than 30 approximately centipoises, in some embodiments of the invention).

Figure 3:
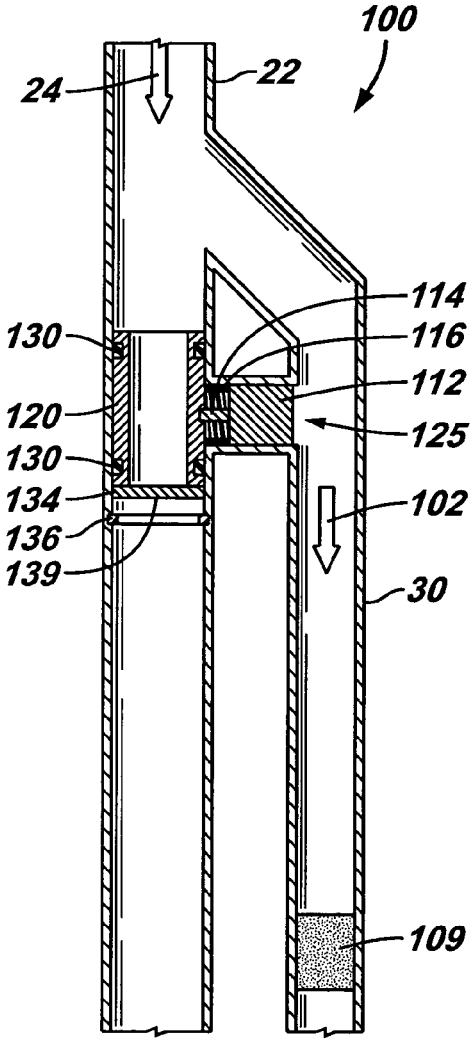
FIGS. 3 and 4 are schematic diagrams showing operation of a leak control device according to an embodiment of the invention.

FIG. 3 depicts a slurry distribution system 100 (in accordance with some embodiments of the invention) that may be used in a particular well section to control slurry flow through alternative flow paths. In accordance with some embodiments of the invention, the system 100 may be located in the vicinity of the union of a shunt tube 22 and a particular packing tube 30.

The system 100 includes a plug 112 that is initially partially inserted into a radial opening 125 of the packing tube 30. In this state, the plug 112 does not impede a slurry flow 102 through the passageway of the packing tube 30. A spring 116 is located between the plug 112 and a sleeve 120. The sleeve 120, in some embodiments of the invention, is coaxial with the shunt tube 22, is closely circumscribed by the shunt tube 22 and is constructed to slide over a portion of the shunt tube 22 between the position depicted in FIG. 3 and a lower position that is set by an annular stop 136. In other embodiments of the invention, the sleeve 120 may be located outside and closely circumscribe the shunt tube 22.

O-rings 130 form a fluid seal between the sleeve 120 and the shunt tube 22. As an example, for embodiments in which the sleeve 120 is located inside the shunt tube 22, the O-rings 130 may reside in annular grooves that are formed in the exterior of the sleeve 120.

Initially, a shear screw 114 holds the spring 116 in a compressed state and holds the sleeve in the position depicted in FIG. 3. The shear screw 114 is attached to the sleeve 120 and extends through the shunt tube 22 and the interior of the spring 116 to the plug 112. Therefore, in its initial unsheared state, the screw 120 keeps the plug 112 from completely entering the radial opening 125 and obstructing the passageway of the packing tube 30.

A lower end 139 of the sleeve 120 contains a rupture disk 134 that controls communication through the end 139. Initially, the rupture disk 134 blocks the slurry flow 24 from passing through the shunt tube 22. Thus, the slurry flow 24 exerts a downward force on the sliding sleeve 120 via the contact of the slurry 24 and the rupture disk 134. When the flow of slurry through the section being gravel packed becomes impeded, the pressure of the slurry 24 acting on the rupture disk 134 increases. The impeded flow may be due to the formation of one or more bridges in the annulus and/or packing tube(s), of the section, such as the exemplary bridge 109 that is shown as being formed in the packing tube 30 of FIG. 3. When the slurry flow into the section becomes sufficiently impeded by the bridge(s), the pressure on the rupture disk 134 increases to the point that the sliding sleeve 120, shears the screw 114, moves downhole and rests against the stop 134. A further restriction of slurry flow by the bridging eventually causes the rupture disk 134 to rupture.

Figure 4:
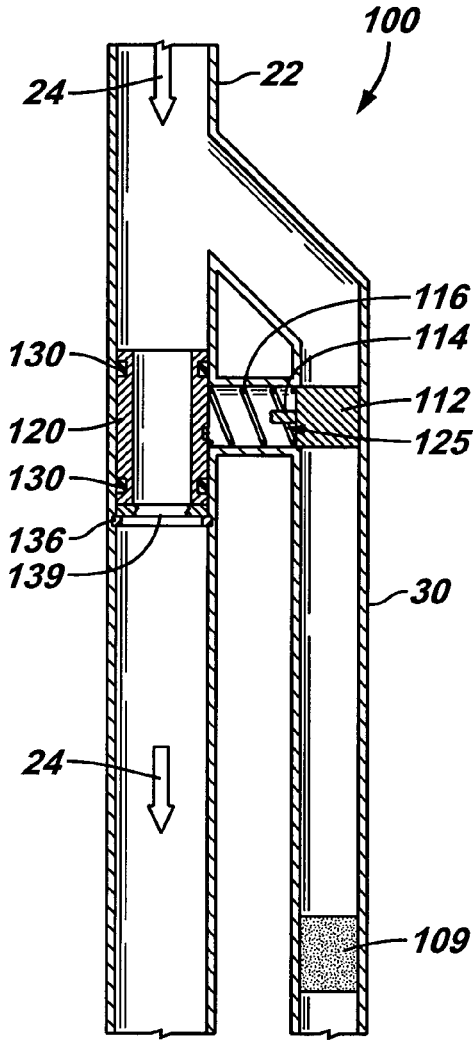

This subsequent state of the system 100 is depicted in FIG. 4. As shown, after the shear screw 114 shears, the spring 116 is free to expand and exerts a radial force on the plug 112, thereby forcing the plug 112 fully into the passageway of the packing tube 30 to seal off the passageway. Thus, entry of the plug 112 into the passageway of the packing tube 30 prevents any further fluid flow through the packing tube 30. This sealing off of the packing tube 30 serves to further increase the pressure on the rupture disk 134 to facilitate its rupture. As depicted in FIG. 4, the rupture of the rupture disk 134 opens communication through the shunt tube 22.

Figure 5:
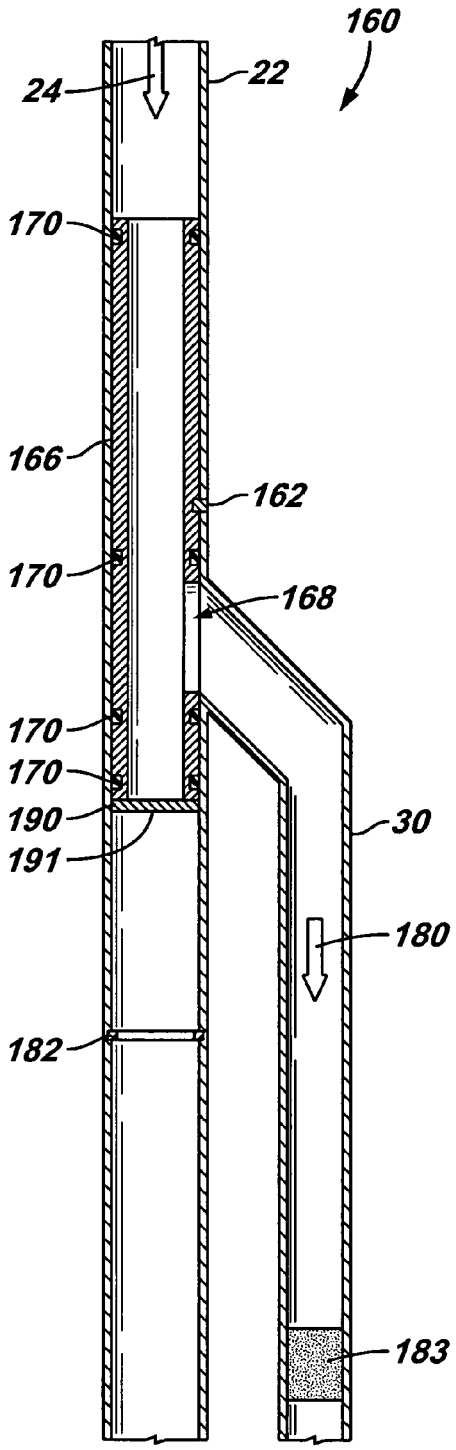
FIGS. 5 and 6 are schematic diagrams depicting operation of another leak control device according to another embodiment of the invention.

An alternative slurry distribution system 160 is depicted in FIG. 5. The system 160 includes a sliding sleeve 166 that is concentric with and slides inside the shunt tube 22, in some embodiments of the invention. Alternatively, the sleeve 166 circumscribes and slides outside of the shunt tube 22, in other embodiments of the invention. The system 160 includes O-rings 170 that are located between the sleeve 166 and shunt tube 22 to form a fluid seal.

As depicted in FIG. 5, the sleeve 166 includes a radial opening 168 that is initially aligned with the opening between the packing tube 30 and the shunt tube 22. Furthermore, a lower end 191 of the sliding sleeve 166 includes a rupture disk 190, thereby initially preventing flow through the shunt tube 22 below the rupture disk 190. Thus, initially, the slurry flow 24 is routed entirely through the packing tube 30.

The sleeve 166 is constructed to move between the position depicted in FIG. 5 and a position in which the lower end of the sleeve 166 rests on an annular stop 182 that is located below the sleeve 166 inside the shunt tube 22. However, the sleeve 166 is initially confined to the position depicted in FIG. 5 by a shear screw 162 that, it its unsheared state, attaches the sleeve 166 to the shunt tube 22.

Over time, bridges, such as an exemplary bridge 183 shown in the packing tube 30, may form to impede the flow of the slurry. The resultant pressure increase in the slurry flow, in turn, creates a downward force on the sleeve 166. After the flow has been sufficiently impeded, the force on the sleeve 166 shears the shear screw 162 and causes the sleeve 166 to slide to the position in which the bottom end of the sleeve 166 rests against the stop 182. In this position, the radial opening 168 is misaligned with the opening to the packing tube 30; and thus, communication between the shunt tube 22 and packing tube 30 is blocked. This blockage along with any additional bridging increases pressure on the rupture disk 190 so that the rupture disk 190 ruptures.

Figure 6:
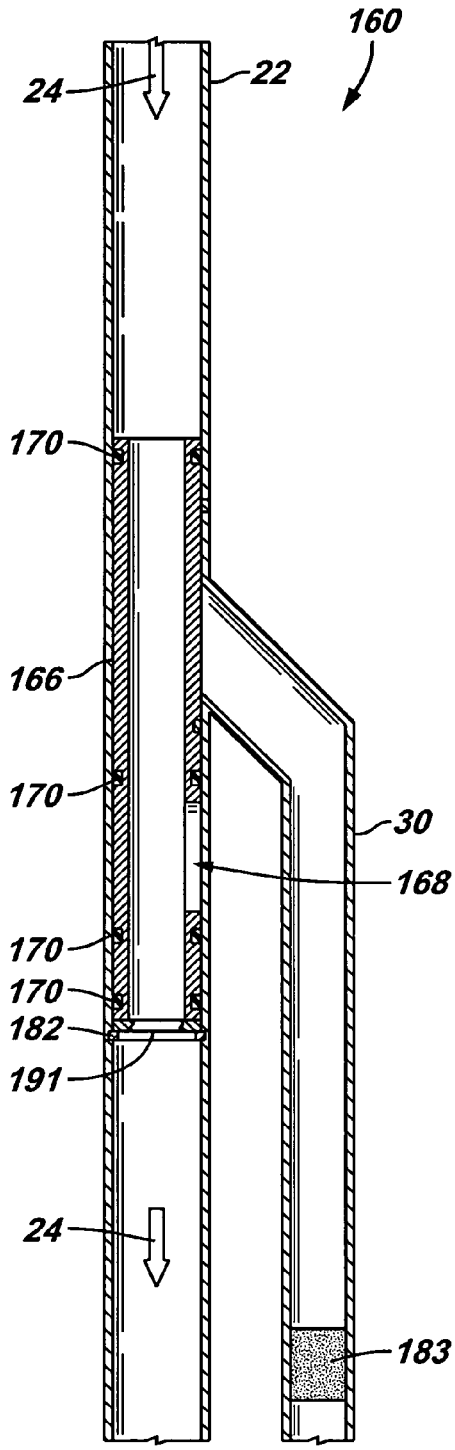

This state of the system 160 is in FIG. 6. As can be seen, in this state, the slurry flow 24 is isolated from the packing tube 30 and is routed by the system 160 through the shunt 22 to the next section to be packed.

In some embodiments of the invention, a dampening layer may be included below a particular rupture disk in the shunt tube 22, such as the rupture disks 134 (FIGS. 3 and 4) and 190 (FIGS. 5 and 6). This dampening layer tends to, as its name implies, dampen a pressure spike that might otherwise propagate through the opening of the rupture disk when the rupture disk ruptures. Such a pressure spike may inadvertently rupture a downstream rupture disk inside the shunt tube 22.

Figure 7:
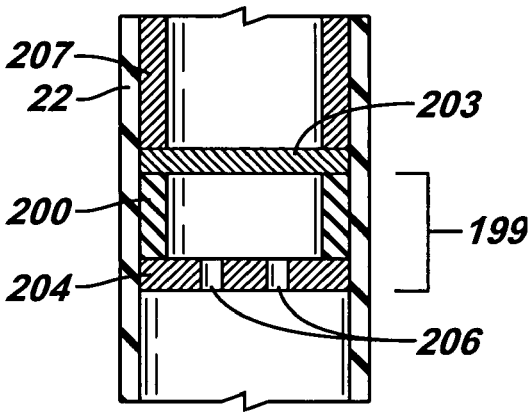
FIG. 7 is a schematic diagram depicting a dampening layer for use with a rupture disk in accordance with an embodiment of the invention.
Figure 8:
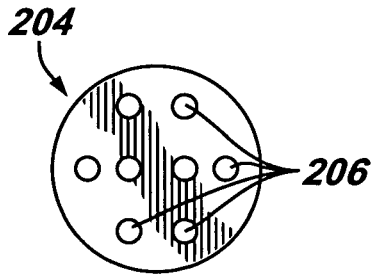
FIG. 8 is a top view of a dampener of FIG. 7 according to an embodiment of the invention.

An exemplary dampening layer 199, in accordance with some embodiments of the invention, is depicted in FIG. 7. As shown, the dampening layer 199 may be formed from a generally circular disk 204 (see also FIG. 8) that is positioned across the cross-section of the shunt tube 22 and includes several openings 206 for purposes of allowing the slurry to flow therethrough. However, the disk 204 is not entirely open, thereby functioning to dampen a pressure spike, if present, when an upstream rupture disk 203 ruptures. In some embodiments of the invention, a cylindrical spacer 200 may be located between the disk 204 and the rupture disk 203. Furthermore, in accordance with some embodiments of the invention, the rupture disk 203 may be attached to the end of a sliding sleeve 207 (such as the sleeve 120 (FIG. 3) or 166 (FIG. 5), for example). In some embodiments of the invention, the rupture disks 203 and disk 204 may have shapes other than the circular shapes that are depicted in the figures.

Figure 9:
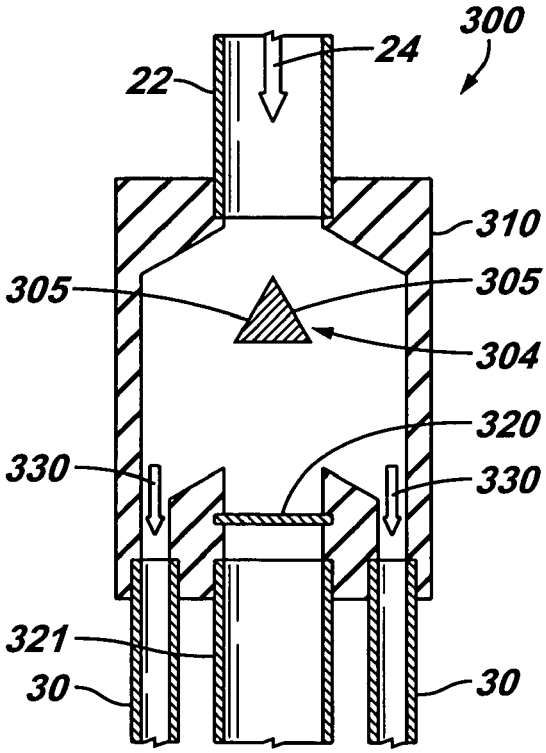
FIG. 9 is a schematic diagram of a slurry distribution system according to an embodiment of the invention.

FIG. 9 depicts another slurry distribution system 300, in accordance with some embodiments of the invention. The system 300 includes a deflector 304 that may be used to deflect a slurry flow 24 from directly contacting a particular rupture disk 320. The rupture disk 320 is located inside and initially blocks communication through an outlet of a manifold, or crossover 310. A shunt tube 321 is connected to this outlet. Therefore, until the rupture disk 320 ruptures, the rupture disk 320 block communication of slurry into the shunt tube 321. As shown, the crossover 310 includes an inlet that is connected to a shunt tube 22 to receive a slurry flow 24. The crossover 310 includes two additional outlets that are connected to two packing tubes 30. Thus, when the rupture disk 320 is intact, the crossover 310 distributes the incoming slurry flow to both packing tubes 30 and does not deliver any slurry to the shunt tube 321.

Figure 10:
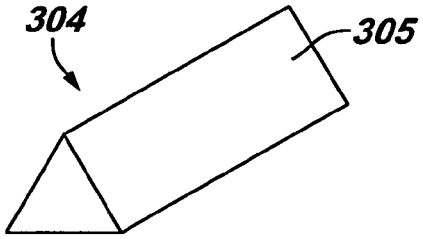
FIG. 10 is a perspective view of a wedge used in the system of FIG. 9 according to an embodiment of the invention.

The central passageway of the shunt tube 22 may be generally aligned with the passageway of the lower shunt tube 321. Therefore, due to inertia, the main flow path along which the slurry flow 24 propagates may generally be directed toward the central passageway of the lower shunt tube 310 and thus, toward the rupture disk 320. The deflector 304, however, deflects the slurry flow 24 away from the rupture disk 320 and toward the corresponding packing tubes 30. As depicted in FIG. 9, in some embodiments of the invention, the deflector 304 may include at least two inclined (relative to the direction of the slurry flow 24) deflecting surfaces 305 for purposes of dividing the slurry flow 24 into two corresponding flows that enter the packing tubes 30. More specifically, in some embodiments of the invention, the deflector 304 may generally be a wedge (FIG. 10), with the side surfaces of the wedge forming the deflecting surfaces 305.

One function of the deflector 304 is to deflect a potential pressure spike that may be caused by the rupture of an upstream rupture disk. Thus, the deflector 304 may prevent premature rupturing of the rupture disk 320. Another potential advantage of the use of the deflector 304 is to prevent erosion of the rupture disk 320. More specifically, in some embodiments of the invention, the rupture disk 320 might erode due to particulates in the slurry 24. Over time, this erosion may affect the rupture threshold of the rupture disk 320. Therefore, without such a deflector 304, the rupture disk 320 may rupture at a lower pressure than desired.

The third function, which may be the major function of the deflector (in some embodiments of the invention), is to divert the gravel to the packing tube, after the rupture disk burst, in order to seal the packing tubes hydraulically.

In some embodiments of the invention, the slurry flow 24 gradually erodes the deflector 302 to minimize any local flow restriction. However, this erosion occurs well after the desired rupturing of the rupture disk 320.

Figure 11:
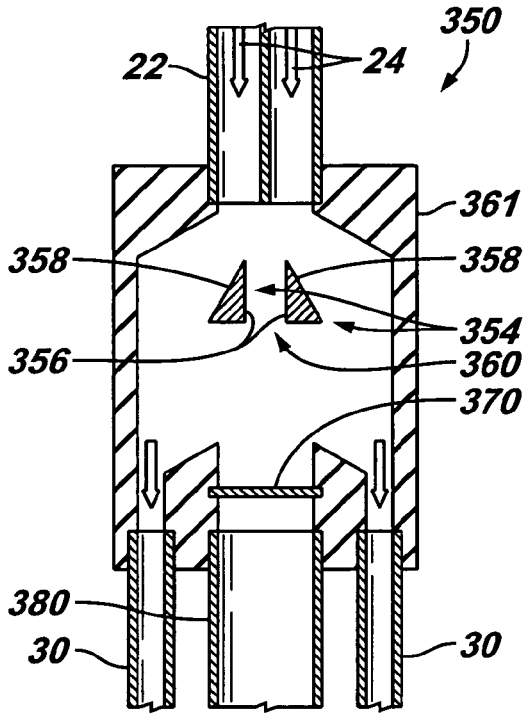
FIG. 11 is a schematic diagram of a slurry distribution system in accordance with another embodiment of the invention.

FIG. 11 depicts another slurry distribution system 350 in accordance with some embodiments of the invention. The system 350 includes two deflectors 354 (wedge-shaped deflectors, for example) that are located inside a crossover 361. The crossover 361 includes two inlets that each receives a shunt tube 22. The crossover 361 has two outlets that are connected to two corresponding packing tubes 30; and the crossover 361 has a third outlet that is connected to a lower shunt tube 380. The crossover 361 includes a rupture disk 370 that initially blocks communication of slurry to the lower shunt tube 380. As shown, the lower shunt tube 380 may be coaxial with the crossover 361.

As depicted in FIG. 11, the two deflectors 354 divert corresponding slurry flows 24 from the shunt tubes 22 into the corresponding packing tubes 30. As shown, in some embodiments of the invention, a gap 360 exists between the deflectors 354. In some embodiments of the invention, each of the deflectors 354 may be a wedge. As a more specific example, each wedge 354 may have an inclined (relative to the deflected flow) deflecting surface 358 for purposes of deflecting the associated slurry flow 24 into the associated packing tube 30. Furthermore, another surface 356 of each deflector 354 may be generally aligned with the longitudinal axis of the shunt tubes 22 for purposes of permitting flow between the deflectors 354. However, the flow between the deflectors 354 is not aligned with either slurry flow 24 to prevent the erosion and premature bursting of the rupture disk 370, as described above in connection the deflector 304 (see FIG. 9).

Figure 12:
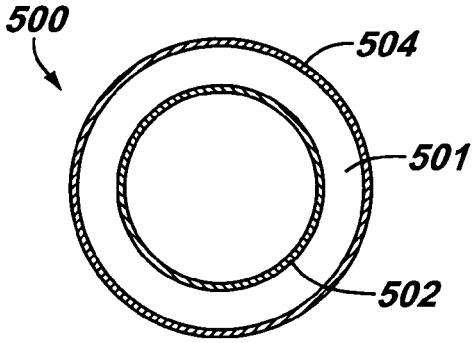
FIG. 12 is a cross-sectional view of a well in accordance with an embodiment of the invention.

Referring to FIG. 12, in some embodiments of the invention, alternative flow paths may be provided by structures other than shunt tubes and packing tubes. In this manner, in some embodiments of the invention, an alternative flow path may be provided by an annular space 501 that exists between the outer surface of a sandscreen 502 and the inner surface of an outer circumscribing shroud 504. Thus, in accordance with some embodiments of the invention, a rupture disk or other flow control device may be located in the annular area 501. Furthermore, deflectors may be also located in the annulus 501 for purposes of performing the function of the deflectors described above. Additionally, in some embodiments of the invention, the radial paths from the outer shroud 504 may be sealed off for purposes of preventing fluid loss, similar to the arrangements depicted in FIGS. 3–6 above. Furthermore, structures other than tubes may provide ancillary flow paths. Therefore, the language "flow path" is not restricted to a flow in a particular tube, as the term "flow path" may apply to flow paths outside of tubes, between tubes, other types of flow paths, etc. in some embodiments of the invention.

Although rupture disks have been described above, it is noted that other flow control devices, such as valves, for example, may be used in place of these rupture disks and are within the scope of the claims.

Orientational terms, such as "up," "down," "radial," "lateral," etc. may be used for purposes of convenience to describe the gravel packing systems and techniques as well as the slurry distribution systems and techniques. However, embodiments of the invention are not limited to these particular orientations. For example, the system depicted in FIG. 1 (and the variations discussed herein) may be used in a lateral wellbore or highly deviated wellbore, for example. Other variations are possible.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

communicating a slurry through a shunt flow path; and operating a first control device to control communication between the shunt flow path and an ancillary flow path, the ancillary flow path being separate from the shunt flow path and having an inlet located upstream of a first portion of the shunt flow path and downstream of a second portion of the shunt flow path.

2. The method of claim 1, wherein the shunt flow path comprises a shunt tube.

3. The method of claim 1, wherein the ancillary flow path comprises a packing tube.

4. The method of claim 1, further comprising:

operating a second control device to control communication of the slurry to another ancillary flow path.

5. The method of claim 4, wherein operation of the second control device occurs after operation of the first control device.

6. The method of claim 4, wherein the operating the second control device comprises:

rupturing a rupture disk.

7. The method of claim 1, wherein operating the first control device comprises:

inserting a plug into a passageway located between the shunt flow path and the ancillary flow path.

8. The method of claim 1, wherein operating the first control device comprises:

moving a sleeve.

9. A system usable with a well, comprising:

a shunt tube adapted to communicate a slurry, the shunt tube comprising a plurality of outlets;

flow control devices located between the outlets to selectively prevent communication between a passageway of the shunt tube and the outlets; and packing tubes connected to the outlets.

10. The system of claim 9, wherein the flow control devices are adapted to sequentially open to permit sequential packing of sections of the well.

11. The system of claim 9, wherein at least one of the flow control devices comprises a rupture disk.

12. The system of claim 9, wherein at least one of the flow control devices is adapted to close off communication through part of the shunt tube until a pressure of the slurry reaches an approximate predetermined threshold and open communication through the part of the shunt tube in response to the slurry reaching the approximate predetermined threshold.

13. The system of claim 9, wherein at least one of the flow control devices is adapted to selectively prevent communication of the slurry to an ancillary flow path.

14. The system of claim 9, wherein at least one of the flow control devices establishes a sufficient pressure to use a low viscosity fluid in the slurry.

15. The system of claim 9, wherein at least one of the flow control devices is adapted to selectively prevent communication of the slurry through at least part of the shunt tube.

16. The system of claim 9, wherein at least one of the flow control devices comprises:

a rupture disk located inside the shunt tube to prevent communication through part of the shunt tube in response to a pressure of the slurry remaining below an approximate threshold.

17. The system of claim 16, wherein the rupture disk is adapted to rupture in response to the pressure of the slurry exceeding the approximate threshold.

18. A system usable with a well, comprising:

a shunt flow path adapted to communicate a slurry; and a first control device adapted to transition from an open state to a closed state to isolate the slurry from being communicated to an ancillary flow path extending from the shunt flow path, the ancillary flow path being separate from the shunt flow path and having an inlet located upstream of a first portion of the shunt flow path and downstream of a second portion of the shunt flow path.

19. The system of claim 18, wherein the first control device is adapted to respond to a pressure in the slurry reaching a predetermined threshold to transition from the open state to the closed state.

20. The system of claim 18, wherein the shunt flow path comprises a shunt tube.

21. The system of claim 18, wherein the ancillary flow path comprises a packing tube.

22. The system of claim 18, further comprising:

a second control device adapted to establish communication of the slurry to another ancillary flow path.

23. The system of claim 22, wherein the second control device is adapted to operate after operation of the first control device.

24. The system of claim 22, wherein the second control device comprises:

a rupture disk.

25. The system of claim 18, wherein the first control device comprises:

a plug adapted to be inserted into the ancillary flow path.

26. The system of claim 18, wherein the first control device comprises:

a sleeve adapted to move in response to a pressure of the slurry.

27. A method usable with a well, comprising:

communicating a slurry through a shunt flow path and at least one ancillary flow path extending from said shunt flow path further into the well, each of said at least one ancillary flow paths being separate from the shunt flow path and having an inlet located upstream of a portion of the shunt flow path and downstream of another portion of the shunt flow path;

flowing at least some of the slurry through said at least one ancillary flow path; and subsequent to the flowing, selectively preventing communication between the shunt flow path and said at least one ancillary flow path.

28. The method of claim 27, wherein the shunt flow path comprises a shunt tube.

29. The method of claim 27, wherein said at least one ancillary flow path comprises at least one packing tube.

30. The method of claim 27, wherein the selectively preventing communication comprises:

closing off communication through the part of shunt flow path until a pressure of the slurry reaches an approximate predetermined threshold and opening communication through the part of the shunt flow path in response to the slurry reaching the approximate predetermined threshold.

31. The method of claim 27, wherein the selectively preventing communication comprises:

selectively preventing communication to at least one of said at least one ancillary flow path.

32. The method of claim 27, wherein the act of selectively preventing establishes a sufficient pressure to use a low viscosity fluid in the slurry.

33. The method of claim 27, further comprising:

communicating the slurry through at least one ancillary flow path of said at least one ancillary flow path.

34. The method of claim 27, wherein the selectively preventing comprises:

providing a rupture disk inside the shunt flow path to prevent communication through the part of the shunt flow path in response to a pressure of the slurry remaining below an approximate threshold.

35. The method of claim 34, further comprising:

rupturing the rupture disk in response to the pressure of the slurry exceeding the approximate threshold.

36. A method comprising:

providing a shunt tube and a packing tube separate from the shunt tube to communicate a slurry through the shunt tube and the packing tube to gravel pack a well;

connecting an inlet of the packing tube to the shunt tube such that the shunt tube extends upstream and downstream of the inlet of the packing tube; and providing a valve in the packing tube.

37. The method of claim 36, further comprising:

providing a plug to selectively seal a passageway of the packing tube.

38. A method comprising:

packing a first section of a well by routing at least part of a slurry through a shunt tube and a first packing tube attached to the shunt tube;

near a conclusion of the packing of the first section, rupturing a first rupture disk in the shunt tube and sealing off communication through the first packing tube; and in response to the rupturing, packing a second section of the well.

39. The method of claim 38, further comprising:

near a conclusion of the packing of the second section, rupturing a second rupture disk in the shunt tube and sealing off communication through a second packing tube.

40. The method of claim 39, further comprising:

in response to the rupturing of the second rupture disk, packing a third section of the well.

* * * * *